US005709530A

United States Patent [19]

Cahill et al.

[11] Patent Number: 5,709,530

[45] Date of Patent: Jan. 20, 1998

[54] GAS TURBINE VANE SEAL

[75] Inventors: Thomas R. Cahill, Tequesta; George A. Gergely, Port Saint Lucie, both of Fla.

[73] Assignee: United Technologies Corporation, Hartford, Conn.

[21] Appl. No.: 707,569

[22] Filed: Sep. 4, 1996

[51] Int. Cl.[6] ..... F01D 5/00

[52] U.S. Cl. ..... 415/170.1; 277/12; 277/192; 277/199; 277/236

[58] Field of Search ..... 415/170.1, 174.2; 277/12, 32, 192, 194, 199, 236

[56] References Cited

U.S. PATENT DOCUMENTS

| | | | |
|---|---|---|---|
| 3,144,255 | 8/1964 | Thorne et al. | 277/173 |
| 3,728,041 | 4/1973 | Bertelson | 415/189 |
| 3,938,906 | 2/1976 | Michel et al. | 415/139 |
| 4,114,248 | 9/1978 | Smith et al. | 29/460 |
| 4,524,980 | 6/1985 | Lillibridge et al. | 277/199 |
| 4,537,024 | 8/1985 | Grosjean | 60/39.161 |
| 4,897,021 | 1/1990 | Chaplin et al. | 415/173.7 |
| 5,154,577 | 10/1992 | Kellock et al. | 415/170.1 |
| 5,221,096 | 6/1993 | Heldreth et al. | 277/227 |
| 5,338,152 | 8/1994 | Feldmann | 415/139 |

FOREIGN PATENT DOCUMENTS

| | | | |
|---|---|---|---|
| 1395196 | 5/1975 | United Kingdom | 277/199 |

*Primary Examiner*—John T. Kwon
*Attorney, Agent, or Firm*—Richard D. Getz

[57] ABSTRACT

A feather seal is provided having a first element and a second element. The first element includes a pair of protrusions and the second element includes a slot for receiving the first element. The first element is slidably received within the slot of the second element, and the protrusions limit the travel of the first and second element relative to one another.

4 Claims, 1 Drawing Sheet

FIG. 1
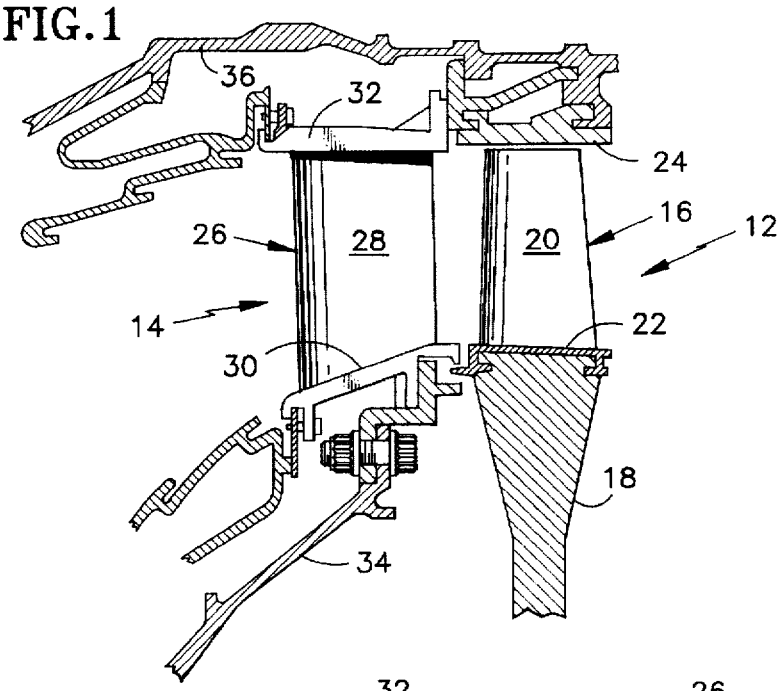
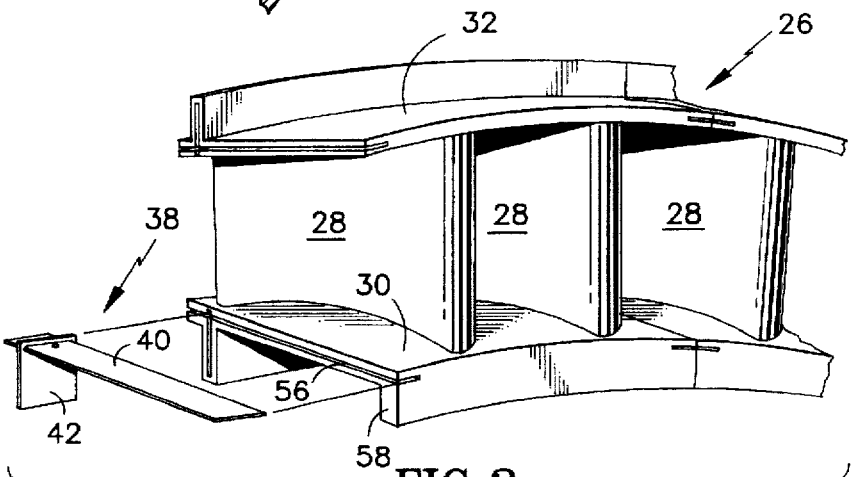
FIG. 2
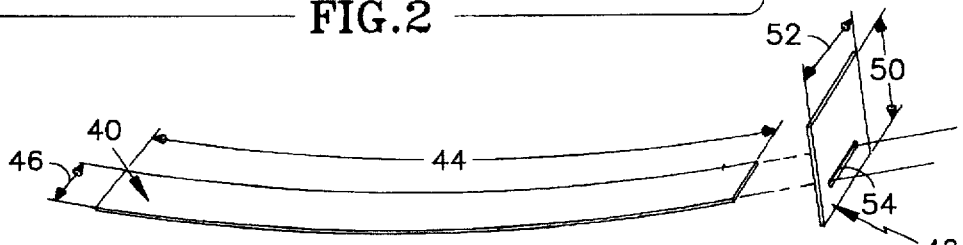
FIG. 3
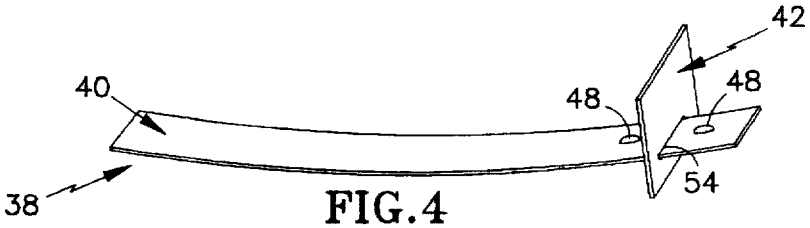
FIG. 4

GAS TURBINE VANE SEAL

The invention was made under a U.S. Government contract and the Government has rights herein.

BACKGROUND OF THE INVENTION

1. Technical Field

This invention relates to seals within gas turbine engines in general, and to seals for sealing between vanes, in particular.

2. Background Information

Rotor assemblies within most modem gas turbine engines typically include a number of rotor stages separated by stator sections. Each rotor stage generally includes a plurality of blades circumferentially distributed around a disk. Each blade consists of a root, an airfoil, and a platform extending laterally outward between the root and the airfoil. The roots are received within the disk and the platforms collectively form an annular surface at the bases of the airfoils. A blade outer air seal is positioned in close proximity to the outer radial surface of the airfoils. The blade outer air seal and the blade platforms define the gas path boundaries through the rotor stage.

The stator sections adjacent the rotor sections generally include a plurality of segments that collectively form an annular assembly. Each segment includes one or more vanes extending between an inner and an outer platform. The inner platforms are attached to a static support structure and the outer platforms are supported by the casing disposed radially outside of the stator section. The inner and outer platforms collectively form the gas path boundaries through the stator section.

To avoid, or minimize, leakage between stator segments, it is known to provide seals between the inner and outer platforms of adjacent segments. The seals, referred to as feather seals, in most cases extend axially along the segment from forward to aft edge and radially along the forward edge of the segment. Slots machined in radial faces of the segments receive the feather seals. A problem with many present feather seals used in a gas turbine stator environment is that they are not flexible enough to accommodate misalignment between adjacent segments. Seals having an axial portion fixed to a radial portion, for example, often have less than desirable flexibility because of the manner of attachment. Making the material more flexible to compensate for the fixed attachment leaves the seal with less than desirable mechanical strength.

What is needed is an apparatus for sealing between stator segments of a gas turbine engine that provides an appropriate amount of flexibility, one that efficiently seals both radially and axially, and one that can be readily manufactured.

DISCLOSURE OF THE INVENTION

It is, therefore, an object of the present invention to provide an apparatus for sealing between stator segments of a gas turbine engine that provides an appropriate amount of flexibility.

It is another object of the present invention to provide an apparatus for sealing between stator segments of a gas turbine engine that seals radially and axially in an efficient manner.

It is another object of the present invention to provide an apparatus for sealing between stator segments of a gas turbine engine that can be readily manufactured.

According to the present invention a seal is provided having a first element and a second element. The first element includes a pair of protrusions and the second dement includes a slot for receiving the first element. The first element is slidably received within the slot of the second element, and the protrusions limit the travel of the first and second element relative to one another.

An advantage of the present invention is its flexibility. The slidable relationship between the first and second elements allows for considerable misalignment between the two elements, which in turn permits misalignment in the stator segments without compromising sealing. The flexibility is a product of how the elements are coupled. The coupling arrangement also allows the use of stiffer elements. Stiffer elements are less apt to be deformed and damaged during use.

Another advantage of the present invention is that it does not require welding. Feather seals that require welding are susceptible to undesirable warpage during the welding steps.

Another advantage of the present invention is that it can be readily manufactured. Once the slot is punched into the second element, the two elements can be assembled and the protrusions added. In the embodiment where the protrusions are dimples, the dimples are simply pressed into the first element on both sides of where the first element is received within the slot.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 1 is a sectional diagrammatic view of a turbine rotor and stator assembly.

FIG. 2 is a perspective view of stator segments showing the present invention seal.

FIG. 3 is an exploded perspective view of the present invention seal prior to assembly.

FIG. 4 is a perspective view of the present invention seal after assembly.

BEST MODE FOR CARRYING OUT THE INVENTION

Referring to FIGS. 1 and 2, the turbine in a gas turbine engine includes a rotor assembly 12 and a stator assembly 14. The rotor assembly 12 includes a plurality of blades 16 attached to a disk 18. Each blade 16 includes an airfoil 20 and a platform 22. A blade outer air seal 24 is disposed radially outside the blades 16. The stator assembly 14 include a plurality of segments 26 (see FIG. 2) that collectively form an annular structure. Each segment 26 includes one or more vanes 28 extending between an inner 30 and an outer 32 platform. The inner platforms 30 are attached to a static support structure 34 and the outer platforms 32 are supported by the casing 36 disposed radially outside of the stator assembly 14. The inner 30 and outer 32 platforms collectively form boundaries for the gas path through the stator assembly 14.

Referring to FIGS. 2–4, seals 38 are circumferentially disposed between the inner 30 and outer platforms 32 of adjacent segments 26. Each seal 38 includes an axial element 40 and a radial element 42. The axial element 40 has a thin plate-like body with a length 44, a width 46, and a pair of dimples 48 extending out of the body. The dimples 48 represent a preferred embodiment of protrusions extending out of the body of the axial element 40. The radial element 42 has a thin plate-like body with a length 50, a width 52, and a slot 54 for receiving the axial element 40. The axial element 40 is slidably received within the slot 54 of the radial element 42 and the dimples 48 are pressed into the axial element 40 subsequently to limit the travel of the axial 40 and radial 42 elements relative to one another. The amount of relative travel between the elements 40,42 can be adjusted by adjusting the distance between the dimples 48.

Referring to FIG. 2, in the assembly of the stator assembly 14, the axial 40 and radial 42 elements of a seal 38 are received within slots 56 machined in the radial face 58 of a first stator segment 26. A second stator segment 26 is subsequently positioned adjacent the first segment and aligned to receive the edges of the seal opposite those edges received within the first segment 26. The assembly process repeats in like fashion until the annular assembly is complete. Spacing is maintained between the stator segments 26 for reasons such as thermal growth, mechanical distortion occurring during flight, etc. The axial and radial elements of each seal 38 prevents radial and axial passage of gas between adjacent segments 26, respectively. In the event adjacent segments 26 are misaligned, the elements 40,42 of the present invention seal 38 slide relative to one another to remain seated within the slots 56 of the adjacent segments 26 and to avoid damage.

Although this invention has been shown and described with respect to the detailed embodiments thereof, it will be understood by those skilled in the an that various changes in form and detail thereof may be made without departing from the spirit and scope of the claimed invention. For example, the present invention seal has been described within the best mode as having a slot 54 in a radial element 42 and dimples 48 in an axial element 40. Alternatively, the slot 54 may be disposed in the axial member 40 and the dimples 48 in the radial member 42. Similarly, protrusions other than dimples 48 may be used, although dimples are the preferred embodiment. The radial 42 and axial 40 elements of the present invention seal have been described as thin plate-like members. Alternatively, the elements 40,42 may have arcuate or complex cross-sections and a flat surface where the elements are joined, or the slot may assume the geometry of the element received within it.

We claim:

1. A seal for sealing between adjacent stator vane segments in a gas turbine engine, comprising:

an axial element, having a length and a width, and a pair of protrusions; and a radial element, having a length, a width, and a slot for receiving said axial element;

wherein said axial element is slidably received within said slot of said radial element; and wherein said protrusions limit the travel of said axial and radial elements relative to one another.

2. A seal according to claim 1, wherein said radial and axial elements are flat and plate-like, and said slot extends widthwise across said radial element.

3. A seal according to claim 2, wherein said slot limits widthwise travel of said axial element relative to said radial element and said protrusions limit lengthwise travel of said axial element relative to said radial element.

4. A seal according to claim 3 wherein said protrusions are dimples pressed into said axial element.

* * * * *